United States Patent [19]

ReMine et al.

[11] Patent Number: 4,888,579

[45] Date of Patent: Dec. 19, 1989

[54] FALSE ALARM MINIMIZATION AND DIRECTION DETERMINATION METHODS

[75] Inventors: Walter J. ReMine; Anthony M. Belka, both of Saint Paul, Minn.

[73] Assignee: Minnesota Mining and Manufacturing Company, Saint Paul, Minn.

[21] Appl. No.: 245,781

[22] Filed: Sep. 16, 1988

[51] Int. Cl.[4] ..... G08B 13/24

[52] U.S. Cl. ..... 340/572; 324/239; 340/551

[58] Field of Search ..... 340/572, 571, 551, 552, 340/561, 870.25; 324/239–243, 225

[56] References Cited

U.S. PATENT DOCUMENTS

| | | | |
|---|---|---|---|
| 3,058,059 | 10/1962 | Bockemuehl | 324/239 |
| 3,617,874 | 11/1971 | Forster | 324/241 |
| 3,665,449 | 5/1972 | Elder et al. | 340/280 |
| 3,740,742 | 6/1973 | Thompson et al. | 340/280 |
| 3,938,125 | 2/1976 | Benassi | 340/280 |
| 4,135,183 | 1/1979 | Heltemes | 340/572 |
| 4,309,697 | 1/1982 | Weaver | 340/572 |
| 4,524,350 | 6/1985 | Eccleston | 340/572 |
| 4,527,152 | 7/1985 | Scarr et al. | 340/572 |
| 4,531,117 | 7/1985 | Nourse et al. | 340/572 |
| 4,535,323 | 8/1985 | Eccleston | 340/572 |
| 4,609,911 | 9/1986 | Nourse et al. | 340/572 |
| 4,635,041 | 1/1987 | Maimann et al. | 340/572 |
| 4,639,716 | 1/1987 | Payne | 340/571 |
| 4,663,612 | 5/1987 | Mejia et al. | 340/572 |
| 4,686,513 | 8/1987 | Farrar et al. | 340/572 |
| 4,697,170 | 9/1987 | Hoekman | 340/551 |
| 4,720,701 | 1/1988 | Lichtblau | 340/572 |
| 4,779,049 | 10/1988 | Aichele | 324/225 X |

*Primary Examiner*—Reinhard J. Eisenzopf
*Assistant Examiner*—Robert W. Mueller
*Attorney, Agent, or Firm*—Donald M. Sell; Walter N. Kirn; Peter Forrest

[57] ABSTRACT

Markers in different portions of the interrogation zone of an electromagnetic article surveillance system produce signals with waveforms of different character. In one embodiment, a false alarm minimization method determines the character of the waveform of the signal induced in the detection antenna. A requirement that signals with waveforms of different character be sensed provides greater confidence that the marker is passing through, as opposed to being near one portion of, the interrogation zone. Also, false alarms produced by stationary objects such as metallic door and window frames are eliminated. In another embodiment, the direction in which the marker passes through the interrogation zone is determined.

20 Claims, 2 Drawing Sheets

FALSE ALARM MINIMIZATION AND DIRECTION DETERMINATION METHODS

Technical Field

This invention relates to methods for reducing false alarms in electronic article surveillance systems and methods for determining the direction in which a marker of such a system passes through an interrogation zone.

Background

Electronic article surveillance (EAS) systems generally comprise an interrogation antenna for transmitting an electromagnetic signal into an interrogation zone, markers which respond in some known electromagnetic manner to the interrogation signal, an antenna for detecting the response of the marker, a signal analyzer for evaluating the signals produced by the detection antenna, and an alarm which indicates the presence of a marker in the interrogation zone. The alarm can then be the basis for initiating one or more appropriate responses depending upon the nature of the facility. Typically, the interrogation zone is in the vicinity of an exit from a facility such as a retail store, and the markers can be attached to articles such as items of merchandise or inventory.

In the ideal case, the system initiates an alarm only when a marker passes through the interrogation zone, unless the marker has been "deactivated" in some manner. However, false alarms may result from the presence of objects, in or near the interrogation zone, which produce a consistent, marker-like response upon each interrogation, as well as from non-repetitive electrical transients, electromagnetic interference, etc. The marker itself may create a false alarm if it is near to, but not in, the interrogation zone. Other objects which create a marker-like response may also create a false alarm whether in or adjacent to the zone. Several methods for rejecting such false alarms have been incorporated into existing EAS systems. Three broad classes of methods exist.

A priori, the marker is selected with the goal of producing a unique signal when appropriately interrogated, and the detection portion of the EAS system is specifically designed to respond preferentially to the unique signal produced by the marker. For example, a common application of this approach uses markers comprising magnetic materials exhibiting high permeability and low coercivity, especially in configurations which generate very high order harmonics of a fundamental frequency present in a periodically oscillating applied magnetic field. Common, non-marked objects, even if comprising magnetic elements, generally will not produce the same high order harmonic response. The detection portion of the system is then designed to determine the presence of such very high order harmonics. U.S. Pat. No. 3,665,449 (Elder, et al.) is an example of such a system.

Another type of EAS system employing a magnetic marker which produces two distinct signals, one due to a magnetic characteristic of the marker and one due to a conductive characteristic, is taught in U.S. Pat. No. 3,938,125 (Benassi). False alarm rejection is achieved by requiring detection of at least both signals.

A variation on the theme of achieving a marker response which is distinguishable from common objects, is to modify the response produced by the common objects themselves. For example, false alarms may be generated by variable electric currents induced in substantially closed electrical loops such as formed by metal door or window frames. The false alarms may be minimized by reducing variations in conductance around the loop. A method for doing this is taught in U.S. Pat. No. 4,697,170 (Hoekman). The method comprises connecting metal straps across all joints in such loops to ensure permanent, reliable electrical connections at all such joints.

The second broad class of false alarm minimization methods focuses more on signal processing circuitry rather than marker identity. The simplest approach is to require more than one signal before an alarm is initiated. For example, in U.S. Pat. No. 3,740,742 (Thompson, et al.), a marker has three separately tuned resonant circuit elements, and an antenna system has three similarly tuned receivers. The receivers are connected in series, thus all three must be activated to initiate an alarm.

Another example is disclosed in U.S. Pat. No. 4,531,117 (Nourse, et al.) and U.S. Pat. No. 4,609,911 (Nourse, et al.). That system recognizes that LC circuits designed to resonate at a single center frequency nonetheless exhibit a certain bandwidth and a range of resonant frequencies dictated by production tolerances in the components of the LC circuit. The system thus creates within the interrogation zone multiple radio frequency (RF) signals which encompass the bandwidths of the resonant frequencies of the LC circuit markers. The signal analysis electronics requires that responses to at least three RF frequencies, all within the bandwidth of a marker, be detected before an alarm is generated.

Another type of signal processing is taught in either of two related references, U.S. Pat. No. 4,524,350 (Eccleston) or U.S. Pat. No. 4,535,323 (Eccleston). Appropriate circuitry for "summing" and "differencing" signals from antennas on opposite sides of the interrogation zone is provided. The resultant "summed" and "differenced" signals have different frequency content spectra. Markers and non-markers have significantly different spectra after their signals are so processed, even if they produce signals similar to each other before processing. Therefore, through multiple steps of comparison techniques, alarms are issued only when markers are detected.

Still another type of signal processing is known as "feature extraction" in U.S. Pat. No. 4,668,942 (Eccleston, et al.). This is a method of comparing received signals to a "baseline" signal known to represent a marker. False alarms are minimized because non-marker signals, even if nearly the same as marker signals, will not identically match the baseline.

The third broad class of false alarm rejection considers the nature of the background noise detected with or without the presence of the marker in the interrogation zone. U.S. Pat. No. 4,720,701 (Lichtblau) describes an EAS system incorporating one or more features designed to improve system performance based on the features of the noise expected.

Regardless of the false alarm minimization method employed, the interrogation and detection antennas are important components of an EAS system. An antenna configuration suitable for either application is a "figure-8" shape, as taught in U.S. Pat. No. 4,135,183 (Heltemes). This configuration is especially suitable, because it tends to cancel signals from distant noise sources.

SUMMARY OF INVENTION

It has been discovered that, in an electronic article surveillance system, a signal produced by a marker has a waveform of a first character when the marker is within a first portion of an interrogation zone, and a waveform of a second, opposite character when the marker is within a second portion of the zone. Thus, when a marker sequentially passes through the two portions, signals with the two different waveform characters are produced. Waveforms of signals arising from stationary objects do not exhibit such a dual, sequential nature, because the objects are not sequentially located in both portions of the zone. Thus, one embodiment of the present invention comprises sensing at least two signals of opposite character waveforms in a sequence within a period of time, and initiating an alarm only upon the sensing of two such signals.

Furthermore, the invention can also be embodied as a method for determining the direction in which a marker passes through an interrogation zone. In this embodiment, the sequence of the detected signal characters is compared to that of the signal characters produced when a reference marker passes through the interrogation zone in a known direction.

DETAILED DESCRIPTION

Figure 1:
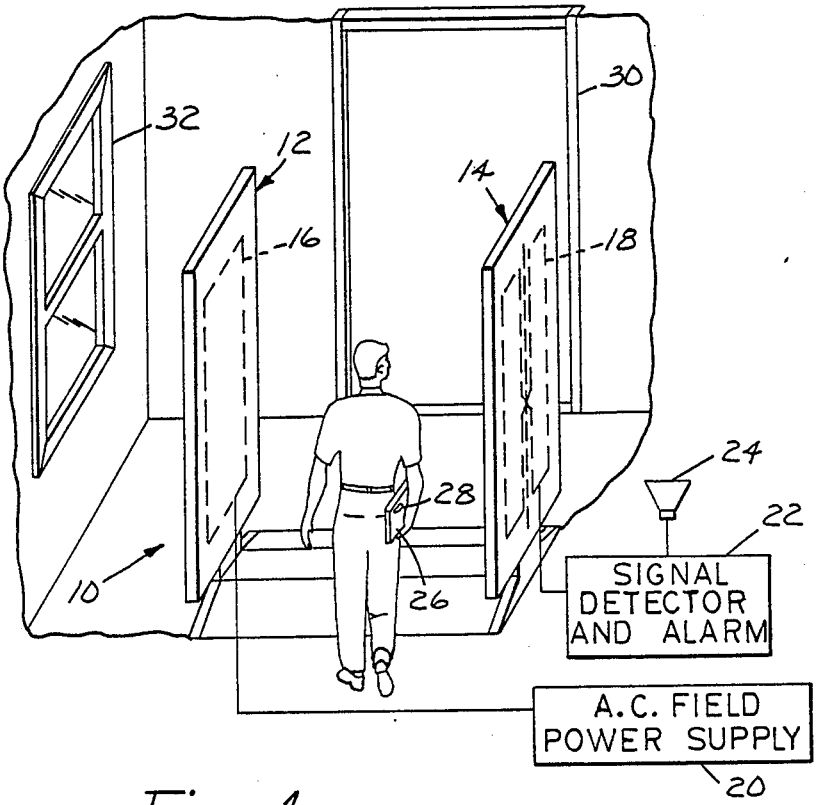
FIG. 1 is a combined perspective view and block diagram of one embodiment of the present invention.

FIG. 1 is a combined perspective view and block diagram of an EAS system 10 located near the exit from a facility. The embodiment shown in FIG. 1 is an EAS system utilizing magnetic markers and appropriate circuitry. It will be apparent, however, that the principles of the invention are not limited by this choice of application for illustrative purposes, and that the invention is equally applicable to systems using markers with LC or RF circuitry, etc. In FIG. 1, pedestals 12 and 14 are positioned to define a corridor between the pedestals. An interrogation zone of the EAS system extends in and around this corridor, the exact extent determined by the arrangement and strength of the electromagnetic fields used to create the interrogation signal. While it is common in the art to consider the interrogation zone as lying only between the pedestals, it should be understood that in the context of this invention the term is taken to include additionally the region surrounding each entire pedestal, including that portion immediately outside the corridor.

Within the pedestals 12 and 14 is at least one interrogation antenna 16 and at least one detection antenna 18. Preferably, each pedestal contains both an interrogation and a detection antenna, each pair of antennas being appropriately coupled to, for example, increase the strength or spatial extent of the fields created or detected. For clarity, FIG. 1 shows only one antenna in each pedestal. Typically, the interrogation antenna is a conductive coil energized at a predetermined frequency (e.g., ten kilohertz) by a source of alternating current such as the power supply 20. Signals induced in the detection antenna 18 are processed by a signal detector and alarm circuit 22 to provide a suitable alarm by a speaker or similar device 24. An article, such as a book 26, has a marker 28 comprising a piece of high permeability magnetic material. When the article, and thus the marker, is carried into the interrogation zone, the alternating field produced by the interrogation antenna 16 causes the magnetization within the marker 28 to reverse repeatedly. This in turn produces signals which are detected by the detection antenna 18. After appropriate signal processing, the system initiates the alarm.

As noted above, such systems are often located near an exit such as doorway 30, and in many instances may also be positioned near a window 32. As described in U.S. Pat. No. 4,697,170 (Hoekman), doorways and windows can cause false alarms if they are constructed of metal. Such false alarms should be suppressed by the system. Furthermore, as depicted in FIG. 1, a marker 28 which is near, but not quite within, the region between the pedestals, can also initiate an alarm. In facilities such as retail stores, patrons might be in the vicinity of the exit and in possession of merchandise to which markers are attached, but the patrons are not attempting to leave the store through the exit. Such false alarms should also be suppressed by the system.

Figure 2:
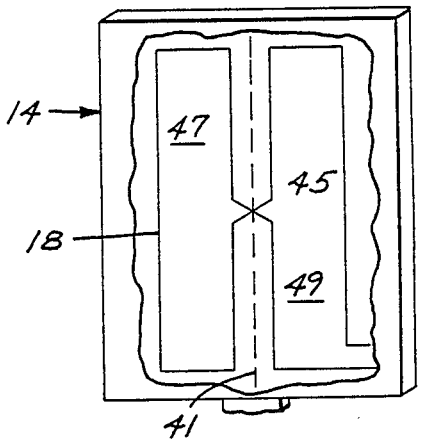
FIG. 2 is a isometric view of a pedestal component of the embodiment of FIG. 1, with parts broken away to show the interior of the pedestal.

FIG. 2 is a side view of pedestal 14 within which is the preferred embodiment of detection antenna 18. This embodiment is a variation of that taught in U.S. Pat. No. 4,135,183 (Heltemes), especially in FIGS. 4B, 5B, and 6B of that patent. As shown in FIG. 2, the detection antenna 18 is substantially a "figure-8" shaped coil, consisting of two substantially rectangular sections 47 and 49, symmetric with respect to an axis 41 lying in the plane of the coil and passing through the crossing point 45. In the embodiment shown in FIG. 2, the axis 41 is vertical, thus the detection antenna 18 has been rotated by 90 degrees in the plane of the page from a "figure-8" representation. This arrangement is known as a "rotated figure-8" representation, i.e., a "figure-8" so that the loops of the figure-8 lie in the generally anticipated direction of marker travel. This direction is left to right or vice versa for the configuration shown in FIG. 2.

When such a "rotated figure-8" detection antenna is employed, the preferred embodiment of the interrogation antenna is a substantially rectangular coil of the same approximate dimensions as would exactly enclose the detection coil. The antennas should be installed so the effects of mutual inductance between them cancel. It is also possible, although not as preferred, to reverse the roles of the preferred antenna configurations, i.e., to use a "rotated figure-8" interrogation coil and a substantially rectangular detection coil.

However, it should be understood that the invention may be embodied in any EAS system which comprises: (1) an interrogation zone with at least two spatially separated portions, (2) a marker which, when passing sequentially through first one portion and then the second portion of the interrogation zone, induces signals in a reception antenna or antennas, and (3) a system of interrogation and detection antennas which produces signals of opposite character, as defined below, within a given period of time as the marker passes through the interrogation zone. Systems comprising more than two interrogation zone portions, multiple loop antennas such as a "double figure-8," systems based on RF or LC marker technology, etc., all may have the invention embodied in them.

Figure 3:
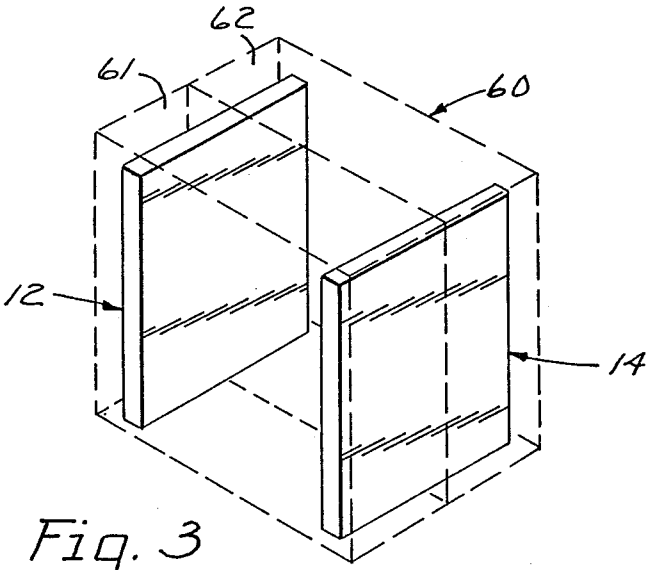
FIG. 3 is a perspective diagram of an interrogation zone surrounding the pedestal component of FIG. 1.

As shown schematically in FIG. 3, the interrogation zone 60 substantially surrounds the pedestals 12 and 14. In the embodiment shown in FIG. 3, interrogation zone 60 is generally divided in half into left and right portions by a vertical plane perpendicular to the pedestals 40 and 50. It is clear that "left" and "right" are arbitrary, depending on the orientation shown in FIG. 3. For this reason, once the portions of the interrogation zone are chosen and fixed they may be given the arbitrary labels "alpha," "beta," etc. These labels should then remain fixed to respective portions of the zone. Thus, interrogation zone 60 comprises alpha portion 61 and beta portion 62. It should also be appreciated that the entire interrogation zone may comprise more that two portions. Thus, the term "interrogation zone" means the full extent of the region surrounding the pedestals, or any subdivision of that region, which includes at least two portions such that a different signal character is produced in each portion.

Figure 4:
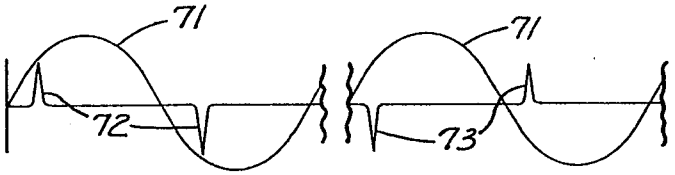
FIG. 4 is a stylized oscillogram showing representative waveforms of an interrogation signal and a signal induced in a detection antenna of the present invention.

It has been found that when a marker passes sequentially from an alpha portion 61 of the interrogation zone 60 to a beta portion 62, the character of the waveform of the signal induced in the detection antenna 18 of FIG. 2 changes. FIG. 4 shows stylized oscillograms of the waveform 71 of a typical sinusoidal interrogation signal, and waveforms 72 and 73 of typical induced signals. The two portions of FIG. 4 represent what would be observed as the marker is located in two portions of the interrogation zone, e.g., alpha portion 61 and beta portion 62 of FIG. 3. Comparing the two portions of FIG. 4, it is clear that waveforms 71 and 72 have a "phase relationship" in the first portion of the figure which is the opposite of that of waveforms 71 and 73 in the second portion of the figure. This change in the waveforms of the induced signals with respect to the interrogation signal is called a change in "character" of those waveforms. This change in character could also be thought of as a "polarity reversal" or "signal inversion."

If the marker passes through the entire interrogation zone, the change in character would normally be observed in time as a smooth transition, but for clarity only two induced signal waveforms 72 and 73 are shown, corresponding roughly to the locations in the interrogation zone where the induced signal strengths are greatest. In general, this is at those locations where the marker is in the centers of the interrogation zone portions 61 and 62, respectively, but this depends on the exact field configurations produced in the interrogation zone 60, which in turn depends on the antenna configurations chosen.

Typically, both the induced signals and the interrogation field are measured with respect to the ground level of the detection electronics. If the signal processing electronics inverts the sense of the induced signals, this should be taken into account. Also, in FIG. 4 the waveforms 71–73 of the interrogation and induced signals are shown to scale on the same horizontal time axis, but the magnitudes of the signals are not necessarily to scale on the vertical axis.

Highpass filters are used in the art to remove from the induced signal a range of frequencies, typically from zero to some low order harmonic frequency of the interrogation signal frequency. For example, if the interrogation signal is ten kilohertz, and the ninth harmonic frequency is chosen, the bandpass filter will remove essentially from zero to ninety kilohertz. Such filtering of the signals induced in one or more portions of the interrogation zone may change the exact shape of the induced signal waveforms. The use of other types of markers may also affect the shape and number of pulses in the induced signal waveforms, but does not affect the applicability of the invention. Furthermore, if non-sinusoidal interrogation signals are employed, an induced signal waveform other than the two oppositely valued peaks illustrated may be produced, but the "change" or "reversal" or "inversion" of the induced signal with respect to the interrogation signal will still be observed. Thus, modifications to the exact definition of "positive" or "negative" signal character may be desirable, depending on the particular equipment chosen, but the invention may still be employed so long as the concept of a "change in character" is employed.

For example, a suitable determination of character is essentially a numerical technique, by which one determines character of the signal directly without the intermediate step of producing the graphical waveform. Thus, "character of a waveform of a signal" and "character of a signal" become essentially synonymous. The character of a signal may be determined by transforming the waveform to a pure number through known signal processing techniques, and considering the algebraic sign of that number. Thus, the invention may be described by saying that it has been found that if the induced signal character is "positive" in an alpha portion 61 of an interrogation zone 60, it will change to "negative" in a beta portion 62.

In an EAS system employing either analog or digital signal processing techniques, it is possible to determine the "product" of two induced signals. This is done by multiplying, at each point of time chosen, the instantaneous values of both signal strengths. If the time-weighted average of this product signal is positive, the two signals have the same character, but it is not known if both are positive or both are negative. If the time-weighted average is negative, the two signals have relatively opposite character, but it is not known which is positive. But, if one of the signals is known to have a positive character, the exact character of the other signal may be determined. Thus, a preferred embodiment of this invention employs at least one reference marker to create at least one reference signal of known character, and stores the reference signal through any means known in the art. Then, when a given marker is in a portion of the interrogation zone, the character of the induced signal is determined through the multiplication of the respective instantaneous values of the given marker signal and the stored reference signal, as described above. The use of a reference signal allows one to determine an "absolute" character of the signal produced by the given marker in a portion of the interrogation zone. This is defined for the purposes of this invention and the claims as the "product/reference method" of character determination. A further preferred embodiment arbitrarily assigns the reference signal a given character, such as "positive."

Whatever the method of character determination employed, the change of character allows the system to minimize false alarms. A stationary object such as a door frame, or a marker which is near the entrance to the interrogation zone, can only induce a signal of one character. In contrast, a marker passing through the interrogation zone sequentially induces two signals of opposite character. Thus, false alarms may be minimized by requiring, for the initiation of an alarm, that at least two signals of different character be sensed within a period of time. The period of time should be chosen to be at least as long as that reasonably taken to carry an article from one portion of the interrogation zone to another. For a retail store exit, this will typically be about one to two seconds.

The second signal need not necessarily be detected immediately after the first. Indeed, the typical speeds of analog or digital electronics suitable for use with the invention are such that a second signal detection could occur only some milliseconds after the first. This may be faster than a marker could pass from one portion of the interrogation zone to another, e.g., it is much faster than a person could walk through a typical retail store exit. Thus, a preferred embodiment requires that a minimum period of time between detected signals of different character have occurred before the alarm is initiated.

The principles discussed above implicitly define a method whereby a sequence of at least two waveform characters is determined, but the emphasis is on using the fact that the waveform characters are different from each other, not that they occur in a specific sequence. The same waveform character information may be used in a different context, by explicitly considering the specific detected sequence of waveform characters. In this embodiment, the same waveform or signal character information may be used to determine the direction in which a marker passes through an interrogation zone.

First, it is necessary to unambiguously associate a particular direction through the interrogation zone with a particular sequence of a pair of different signal characters. For example, "alpha to beta" (or "left to right") must be associated with either "positive before negative" or "negative before positive." To do this, one determines the signal characters expected of a marker in each of the portions of the interrogation zone. This determination may be performed by one skilled in the art by application of known electromagnetic relationships. It also may be done by actually sensing the waveform characters, as by placing a reference marker in one or both portions of the interrogation zone and observing the waveform on an oscilloscope, or simply walking through the zone with a reference marker and noting if the alarm is activated. Once this is done, it is possible to associate a reference sequence, either "positive before negative" or "negative before positive," with the direction in which a given marker should pass through the interrogation zone in actual use. This is known for the purposes of this invention as "associating character sequence and direction." Once this is done, a comparison of a given character sequence with a reference sequence will determine the direction in which the marker producing the given sequence passed through the interrogation zone.

To ensure repeatability, some means for fixing the reference sequence into the EAS system is preferred, although the actual embodiment depends on the particular design of the system. Wired circuitry, software, firmware, field-adjustable switches, and the like are all acceptable.

The steps above can be done during system design, or as part of the installation procedure of the system. Then, in day-to-day application, the system would sense the characters of signals induced in the detection antenna by a given marker in both portions of the interrogation zone. In the preferred embodiment, the "product/reference method" defined above is employed in each portion of the interrogation zone. The system then determines the sequence of the two signal characters produced by the given marker. Comparison of this sequence to the reference sequence determines if the given marker passed through the alpha and beta portions of interrogation zone in the direction "alpha to beta" or the opposite direction beta to alpha." The actual physical installation of the pedestals in relationship to the exit will determine the association between the reference direction and the pedestal configuration, i.e., if "alpha to beta" is "left to right" or "in to out" etc. It is preferable that this association also be fixed in the EAS system with wired circuitry, software, firmware, field-adjustable switches, etc.

The ability to determine direction of marker movement allows an EAS system to be applied to a location where bi-directional movement of marked articles through an interrogation zone is desired, but an actual alarm should be initiated only if a marked article moves through the interrogation zone in a certain direction. For example, in the retail store situation, if a marked article from one store is brought into a second store it presumably is not a theft attempt from the second store, but it is desirable to know that marked articles are inside the store. Thus, if the article moves through the zone in the one direction, a lower importance "trouble" signal can be initiated, instead of the alarm which would be initiated if the article moves through the zone in the other direction.

Figure 5:
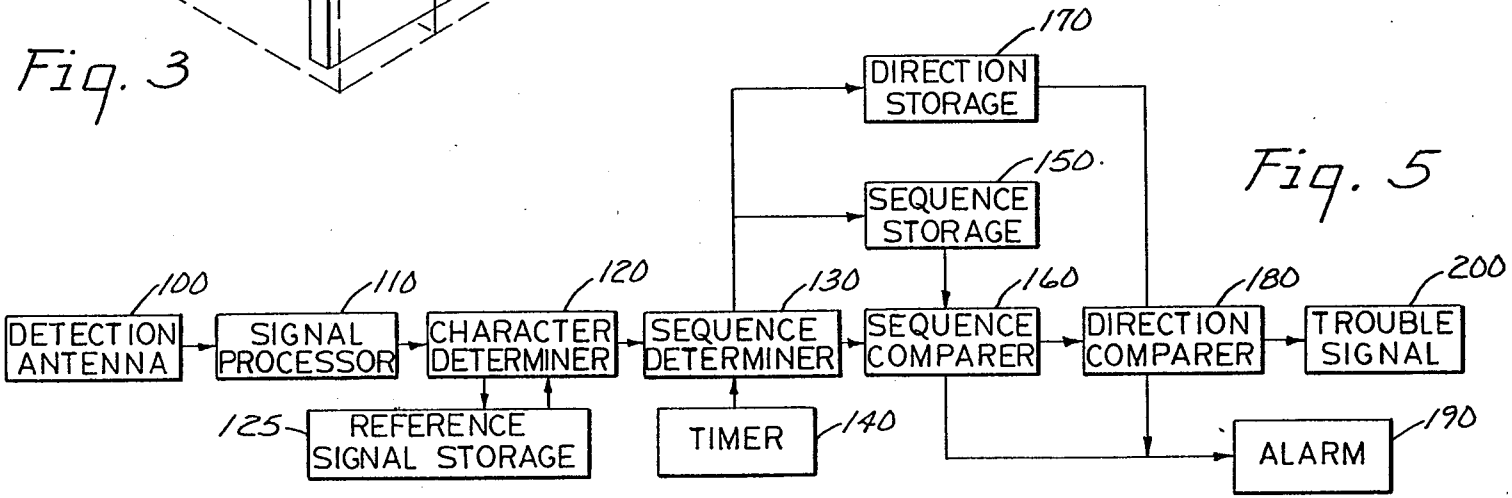
FIG. 5 is a block diagram of an embodiment of the present invention.

FIG. 5 is a block diagram of an embodiment of the invention incorporating both a false alarm minimization method and a direction determination method. Because the invention may employ either traditional analog electronics or digital electronics, those of ordinary skill may employ either or both types of components for any or all of the block elements of FIG. 5 as appropriate. If digital techniques are chosen, an appropriate analog/-digital converter (not shown) is used.

The signals produced by a reference marker passing sequentially from an alpha portion to a beta portion of the interrogation zone are detected by the detection antenna 100. The signals are then appropriately processed by signal processor 110. Such processing will typically include increasing signal gain, impedance coupling, bandpass filtering, and other techniques known in the art. The characters of the signals are then determined by character determiner 120. In the preferred embodiment, the reference signal from the alpha portion of the interrogation zone is assigned a positive character by character determiner 120, and stored in reference signal storage 125.

The characters determined or assigned by character determiner 120 are used to determine a reference sequence, either positive before negative (in the preferred embodiment) or negative before positive. This is done by sequence determiner 130, employing the timing information provided by timer 140. This reference sequence is then fixed in sequence storage 150.

A similar process occurs when a given marker passes sequentially from the alpha to beta portions of the interrogation zone. In the preferred embodiment, the product/reference method described above is employed by character determiner 120 to determine the characters of the given marker signals. The result of sequence determiner 130 is compared to the stored reference sequence by sequence comparer 160. If the former sequence matches the reference sequence stored in sequence storage 150, the alarm 190 is initiated.

Also, the sequence determined by sequence determiner 130 can be associated with the physical installation of the pedestals containing the interrogation and detection antennas, thereby determining a reference direction such as "left to right" which is fixed in direction storage 170. The sequence determined for a given marker can pass unchanged through sequence comparer 160 and compared to the reference direction by direction comparer 180, thereby determining the direction in which the marker passed through the interrogation zone. This too can initiate alarm 190, if the direction so determined is the direction desired for the movement of markers through the interrogation zone. If the former direction does not match the stored reference direction, but is sufficiently "marker-like" in all other respects, a trouble signal 200 is initiated instead.

While certain representative embodiments and details have been shown to illustrate this invention, it will be apparent to those skilled in this art that various changes and modifications may be made in it without departing from its full scope, which is indicated by the following claims.

We claim:

1. A method of preventing false alarms in an electronic article surveillance system, comprising:

(a) defining an interrogation zone, comprising alpha and beta portions, by an interrogation antenna and a detection antenna, (b) detecting a marker, which responds to a signal produced by the interrogation antenna to produce in the detection antenna a first signal with a waveform of a first character as the marker is within the alpha portion of the interrogation zone, and a second signal with a waveform of a second character as the marker is within the beta portion, (c) determining if the characters of the waveforms of the first and second signals produced in step (b) are different, and (d) initiating an alarm if the first and second signals detected in step (b) have waveforms of different character and occur within a predetermined period of time.

2. The method of claim 1 in which step (a) comprises providing an antenna which is substantially a "rotated figure-8" shape.

3. The method of claim 1 in which step (c) comprises using a stored reference signal and applying a product-/reference method of character determination to the first and second signals.

4. The method of claim 3 in which the stored reference signal is assigned a given character.

5. The method of claim 1 in which step (d) further comprises requiring that a minimum period of time between detected signals of different character occur before the alarm is initiated.

6. A method of determining a direction in which a marker passes through an interrogation zone of an electronic article surveillance system, comprising the steps of:

(a) defining the interrogation zone to comprise alpha and beta portions by an interrogation antenna and a detection antenna, (b) determining an expected sequence of characters to be produced by a marker passing through the interrogation zone in a particular direction, (c) detecting a marker, responding to a signal produced by the interrogation antenna, which to produce in the detection antenna a first signal with a waveform of a first character as the marker is within the alpha portion of the interrogation zone, and a second signal with a waveform of a second character as the marker is within the beta portion of the interrogation zone, (d) determining the characters of the waveforms of the first and second signals produced in step (c), (e) associating character sequence and direction for the marker, and (f) comparing the character sequence of step (e) to the expected sequence of step (b), whereby a matching of the sequences determines that the marker passed sequentially from the alpha portion to the beta portion of the interrogation zone, and a mismatching of the sequences determines that the marker passed sequentially from the beta portion to the alpha portion.

7. The method of claim 6 in which step (a) comprises providing an antenna which is substantially a "rotated figure-8" shape.

8. The method of claim 6 in which step (d) comprises using a stored reference signal and applying a product-/reference method of character determination to the first and second signals.

9. The method of claim 8 in which the stored reference signal is assigned a given character.

10. The method of claim 6 in which step (d) further comprises requiring that a minimum period of time between detected signals of different character occur before a character sequence is associated with a direction.

11. An electromagnetic article surveillance system comprising:

(a) an interrogation antenna and a detection antenna, defining an interrogation zone which comprises alpha and beta portions, (b) a marker which when passing through the interrogation zone responds to a signal produced by the interrogation antenna to produce sequentially in the detection antenna a first signal having a waveform of a first character as the marker is within the alpha portion of the interrogation zone, and a second signal having a waveform of a second character as the marker is within the beta portion of the interrogation zone, (c) means for determining the characters of the waveforms of the first and second signals produced by the marker, and (d) means for initiating an alarm if the signals detected have different characters and occur within a predetermined period of time.

12. The system of claim 11 in which an antenna is substantially a "rotated figure-8" shape.

13. The system of claim 11 in which determination means (c) comprises means for applying a product/reference method of character determination to the first stored reference signal, and means for applying the product/reference method to the second signal and a stored reference signal.

14. The system of claim 13 in which at least one stored reference signal is assigned a given character.

15. The system of claim 11 in which initiation means (d) further comprises means for requiring that a minimum period of time between detected signals of different character occur before the alarm is initiated.

16. The system of claim 11 further comprising means for determining a direction in which a marker passes through an interrogation zone, comprising:

(a) means for determining an expected sequence of characters tobbe produced by a marker passing through the interrogation zone in a particular direction, (b) means for associating character sequence and direction for a marker, and (c) means for comparing the character sequences of (a) and (b) to each other, whereby a matching of the sequences determines that the marker passed sequentially frm the alpha portion to the beta portion of the interrogation zone, and a mismatching of the sequences determines that the marker passed sequentially from the beta portion to the alpha portion.

17. The system of claim 16 further comprising means for fixing the reference character sequence into the EAS system.

18. The system of claim 16 further comprising means for fixing an association between a reference direction and a pedestal configuration into the EAS system.

19. The system of claim 16 further comprising means for initiating an alarm if the given marker passes sequentially from the alpha portion to the beta portion of the interrogation zone.

20. The system of claim 19 further comprising means for initiating a trouble signal if the given marker passes sequentially from the beta portion to the alpha portion of the interrogation zone.

* * * * *

UNITED STATES PATENT AND TRADEMARK OFFICE

CERTIFICATE OF CORRECTION

PATENT NO. : 4,888,579

DATED : December 19, 1989

INVENTOR(S) : Walter J. ReMine and Anthony M. Belka

It is certified that error appears in the above-identified patent and that said Letters Patent is hereby corrected as shown below:

Title page, Inventors: should read -- Walter J. ReMine, Saint Paul, Minn.; Anthony M. Belka, Stillwater, Minn.--

Col. 9, line 32, after "marker", delete --,--.

Col. 10, line 1, "marker responding" should read --marker which responds--.

Col. 10, line 2, after "antenna," delete --, which--.

Col. 10, line 61, after "method" insert --of character determination--.

Col. 11, line 5, "tobbe" should read --to be--.

Col. 11, line 13, "frm" should read --from--.

Signed and Sealed this

Nineteenth Day of May, 1992

*Attest:*

DOUGLAS B. COMER

*Attesting Officer*

*Acting Commissioner of Patents and Trademarks*